US006234287B1

(12) United States Patent
Pfeiffer

(10) Patent No.: US 6,234,287 B1
(45) Date of Patent: May 22, 2001

(54) SUITCASE WITH INTERCHANGEABLE CASE-SHELLS

(75) Inventor: Michael Pfeiffer, Faistenhaar (DE)

(73) Assignee: MP Michael Pfeiffer Design & Marketing GmbH (DE)

( * ) Notice: Subject to any disclaimer, the term of this patent is extended or adjusted under 35 U.S.C. 154(b) by 0 days.

(21) Appl. No.: 09/355,329

(22) PCT Filed: Feb. 13, 1998

(86) PCT No.: PCT/EP98/00823

§ 371 Date: Sep. 24, 1999

§ 102(e) Date: Sep. 24, 1999

(87) PCT Pub. No.: WO98/35577

PCT Pub. Date: Aug. 20, 1998

(30) Foreign Application Priority Data

Feb. 14, 1997 (DE) ..... 297 02 619

(51) Int. Cl.[7] ..... A45C 13/04

(52) U.S. Cl. ..... 190/123; 190/28; 190/103; 150/105

(58) Field of Search ..... 190/123, 24, 25, 190/28, 119, 120, 121, 122, 107, 603, 105; 206/372; 70/67, 69; 150/105

(56) References Cited

U.S. PATENT DOCUMENTS

| | | | | |
|---|---|---|---|---|
| 1,950,118 | * | 3/1934 | Lifton | 190/120 |
| 2,228,907 | * | 1/1941 | Clark | 190/24 |
| 2,803,368 | * | 8/1957 | Koch | 190/28 |
| 4,540,071 | * | 9/1985 | Schaub et al. | 190/121 |
| 4,630,717 | * | 12/1986 | Tong | 190/126 |
| 4,993,585 | * | 2/1991 | McMahon | 190/123 |
| 5,676,253 | * | 10/1997 | Hsu | 206/372 X |

* cited by examiner

*Primary Examiner*—Allan N. Shoap
*Assistant Examiner*—Tri M. Mai
(74) *Attorney, Agent, or Firm*—Bacon & Thomas PLLC

(57) ABSTRACT

The invention relates to a suitcase with interchangeable case-shells, the central part of which (10) includes two stable half-frames (20, 30) bearing one against the other. Said half-frames (20, 30) are used as supports for the two case-shells (41, 42) of the suitcase. Each shell is detachably connected to the half-frame (20, 30) assigned to it. In order to ensure mutual support of the load, each shell (41, 42; 51, 52) edge is extended, at least in partial portions, by a flange (43, 44) the length of which is chosen so as to ensure that, when the suitcase is closed, the flange of the first shell (41; 51) and the flange (44) of the second shell (42; 52) abut against each other.

12 Claims, 3 Drawing Sheets

SUITCASE WITH INTERCHANGEABLE CASE-SHELLS

The present invention relates to a suitcase with exchangeable suitcase shells and having a central part which comprises two stable frame halves which are articulated to one another. The frame halves serve as supports for two shells which form the suitcase interior, it being the case that each frame half has a handle side, a hinge side, which is located opposite the handle side, and two mutually opposite side parts. The frame and/or the shells may be of any desired general shape, for example of a rectangular, round or oval shape. Within the present context "handle side" of the frame is to be generally understood as being the top side of the frame, located opposite the hinge side, on which a suitcase handle is usually arranged. It is irrelevant to the invention, however, as to whether a handle is actually provided or whether the handle is provided, for example, on the frame regions designated here as side parts or even on the shells. Each shell is connected releasably to the central-part frame half assigned to it. The shells typically have a sheet-like main plane, the periphery of which is adjoined by a border which is turned down essentially at right angles to said main plane. The width of the turned-down border thus determines the depth of the shell and therefore the capacity of volume of the suitcase as well.

Such suitcases with shells which can be exchanged or released from the frame are known, for example, from U.S. Pat. No. 4,270,590 and from the international Patent Application WO 96/02160.

WO 96/02160, to the disclosure of which you are expressly referred here, describes a suitcase with a variable capacity. Since the volume of the interior of conventional suitcases, e.g. overnight cases or holiday cases, is usually constant, it is also necessary to use different suitcases in order to cater for different content volumes. For example, a smaller case is more suitable for a business trip over a number of days than for holiday travel over a number of weeks. The cost of buying a number of suitcases of different sizes is high. Moreover, the suitcases require a large amount of storage space.

In the case of the suitcase described in WO 96/02160, the shells are connected releasably to the frame halves of the central part. This means that it is possible to use shells of different depths in conjunction with one and the same central part. In this manner, the volume of the suitcase can be adapted to the volume of its contents. The shells, which usually consist of a stiff plastic, together with the central part, which consists of light metal or stiff plastic, form a stable suitcase. When the suitcase is not in use, the shells of different depths can be stacked one inside the other. The suitcase thus requires considerably less storage space than a number of conventional suitcases with different volumes. The border of the suitcase shells has a peripheral bordering lip which, from the inside, comes into abutment against a peripheral edge of the associated frame half and is locked.

If a suitcase with exchangeable shells is used as a seat or if further suitcases or other heavy objects are stacked onto such suitcases during transportation, large forces may act, from the outside, on the locking elements of the two shell parts on the respectively associated frame halves.

The problem on which the present invention is based is to develop the known suitcases with exchangeable shells, in particular the suitcase known from WO 96/02160, such that, even when the shell parts are subjected to high loading from the outside, the frame parts and shell parts continue to be held together and thus the stability of the suitcase is still ensured. In this case, the forces acting on the means for locking the respective shell in its associated frame half remain low, with the result that it is possible to use straightforward locking means which allow the user to exchange the shell parts quickly and without complications.

This problem is solved by a suitcase with a variable capacity which has the features of claim 1.

The suitcase according to the invention is characterized in that the border of each shell is extended, at least in some areas, by a surround, of which the width is selected such that, when the suitcase is closed, the surround of the first shell and the surround of the second shell butt against one another and support one another. The surround is suitably of such a width that, when the shell has been inserted into the frame half and locked, the surround terminates essentially flush with the border of the frame half. This ensures that the shells cannot be released from the frame even when they are subjected to high loading from the outside. Since the shell parts support one another, the locking elements need only absorb low forces. Said locking elements may be of relatively straightforward and compact construction, as a result of which the suitcase shells can be exchanged very easily.

The surround preferably forms the extension of the shell border, which is turned down at right angles, and is oriented essentially perpendicularly to the main plane of the shell.

The surround and the suitcase shell usually form a single-piece component, for example a plastic moulding.

Sealing strips are advantageously positioned in the edges of the surrounds, said edges butting against one another when the suitcase is closed. These sealing strips preferably consist of an elastic material. Upon closure of the suitcase, the sealing strips of the two shell parts are pressed against one another and ensure the necessary sealing of the thus defined suitcase interior towards the outside.

The shell is particularly advantageously configured such that the surround runs on all sides except in the hinge region of the shell.

The surround is advantageously connected to the shell via a peripheral folding-lip region.

Each frame half advantageously has, on the inside, a peripheral edge in which there is made, at least in the region of the handle side and of the side parts, a channel in which a strip of the surround of the shell engages. The peripheral edge serves as a stop during the insertion of the shell, while the strip which engages in the channel ensures precise positioning and securing of the shell in the frame half. In addition, the interengagement of strip and channel ensures that, when a heavy suitcase is lifted, the frame and the shell remain connected on the handle side and any possible bending deformation of the handle side of the frame is prevented.

Each frame half preferably has, on the inside side of the hinge side, a groove in which a bordering lip of the respective shell engages and, on the opposite, handle side, at least one means for locking the respective shell in its frame half. This means that the shell is secured in position on the hinge side by the groove/bordering-lip engagement connection and on the other sides by being supported by the surround of the other shells.

In the case of a preferred embodiment of the suitcase according to the invention, the locking means comprises a slide which is fitted in a movable manner on the inside of the handle side of each frame half and interacts with an engagement system provided on the handle side of the surround of the shells. The engagement system is configured here such that, in the open position of the slide, the shell can be brought into abutment against the peripheral edge of the frame half. If the slide is then moved into the closed position, the slide and engagement system interact such that the shell is locked in abutment against the peripheral edge and cannot swing out of the frame half again.

The engagement system for the slide, which may be designed, for example, as ribs projecting from the handle side of the surround, is preferably arranged in the two outer border regions of the handle side.

It is advantageous, if, for each frame half, in each case one slide is provided on either side of the suitcase handle.

The slides are preferably located opposite one another on their frame halves such that, in the locked state and when the suitcase is closed, they block one another against unlocking.

For this purpose, each slide advantageously has an actuating web which projects in the direction of the opening and closing edge of the frame half. When the suitcase is closed, the actuating webs of the two frame halves are then located one beside the other in a partially overlapping manner and thus secure one another against undesired displacement.

The present invention also relates to a suitcase set which comprises a suitcase of the type described above with a plurality of differently configured, exchangeable suitcase shells. To be more precise, it is possible to speak in terms of a suitcase set in the present context if at least three exchangeable shells are provided, at least one shell being configured differently from the other two shells. This may involve, for example, different colouring or shaping, a different surface texture, different fittings inside the shell or different material.

According to a particularly preferred embodiment, however, the suitcase set is formed from a central part and from at least two pairs of the shells of different depths. Such a suitcase set has the advantages of at least two conventional suitcases. Costs are reduced by quicker production cycles and simple assembly. The suitcases according to the invention may be produced in any format. The principle of the invention can be applied to any types of suitcase. In addition, the ability to exchange the shells opens up new possibilities for individual colour coordination of the suitcases. A suitcase set may comprise, for example, both rigid-shell and flexible-shell pairs.

Exemplary embodiments of the suitcase according to the invention are explained hereinbelow with reference to the attached drawings, in which.

Figure 1:
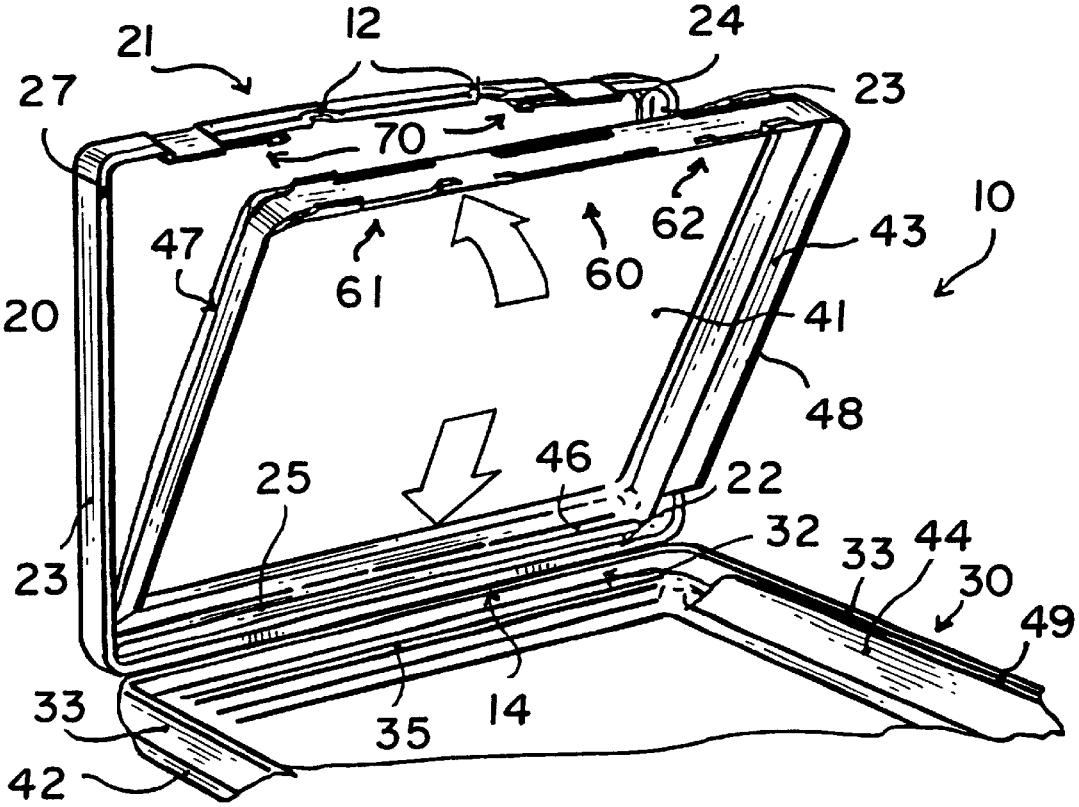
FIG. 1 shows a perspective view of part of the suitcase according to the invention, where one suitcase shell is just being inserted into the frame of the central part.
Figure 2:
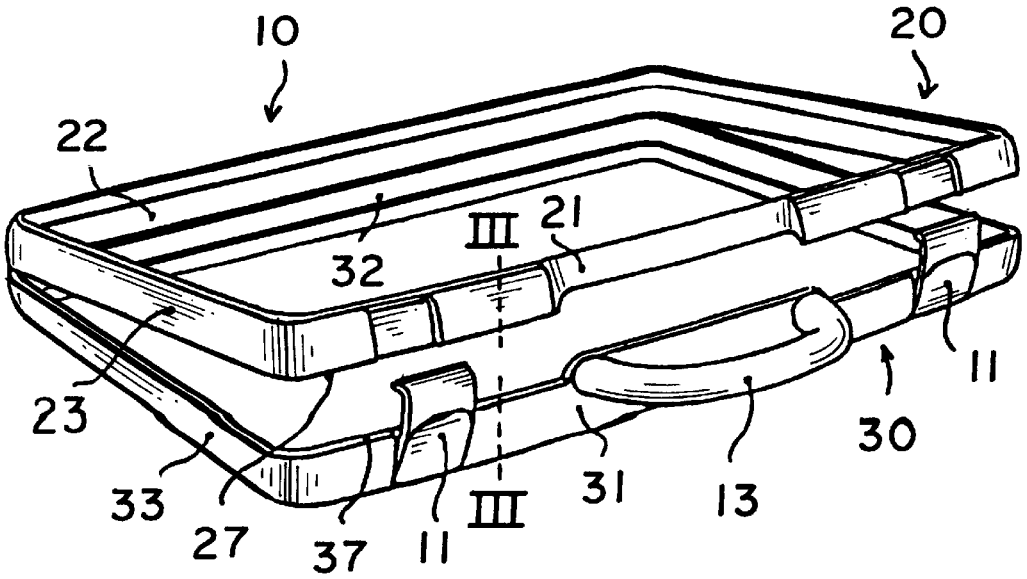
FIG. 2 shows the central part of the suitcase without shells.

A central part 10, which is shown in FIGS. 1 and 2, is formed by two frame halves 20, 30. Each frame half has a handle side 21, 31, a hinge side 22, 32 and two side parts 23, 33. The two frame halves 20, 30 are articulated to one another by hinges 14 and can be brought into abutment against one another along their closing edges 27, 37. Closure devices 11 are provided on those sides of the frame halves 20, 30 which are located opposite the hinges 14. Provided between the closure devices 11, in the frame halves 20, 30, are recesses 12 for accommodating a handle 13 (not shown in FIG. 1). The frame halves 20, 30 each have a peripheral edge 24, 34. Furthermore, on the hinge side 22, 32 of the frame halves 20, 30, interior grooves 25, 35 are provided parallel to the hinges 14.

The suitcase interior illustrated in FIG. 1 is formed by two shallow shells 41, 42 which can be inserted into the central part 10 such that they can be exchanged. The shells 41, 42 each have a peripheral bordering lip 47 which comes into abutment against the peripheral edge 24 of the frame halves 20, 30. On the hinge side 22, 32 of the frame halves 20, 30 the bordering lip 46 comes into engagement in each case behind the grooves or beads 25, 35.

Each shell is extended beyond the bordering-lip region 47 by a surround 43, 44. The width of the surround is dimensioned such that, when the suitcase is closed, the surrounds 43, 44 of the shells 41, 42 butt against one another, with the result that—apart from the hinge region—the suitcase interior is completely enclosed by the two shells 41, 42. Provided on the surround region which is assigned to the handle side 21, 31 is an engagement system 60 which, in order to lock the shells 41, 42 in the frame half 20, 30 interacts with the two slides 70 provided on the bottom of the handle side. In the case of the embodiment illustrated, which has two slides 70, a first engagement system 61 and a second engagement 62 are thus provided.

Figure 3:
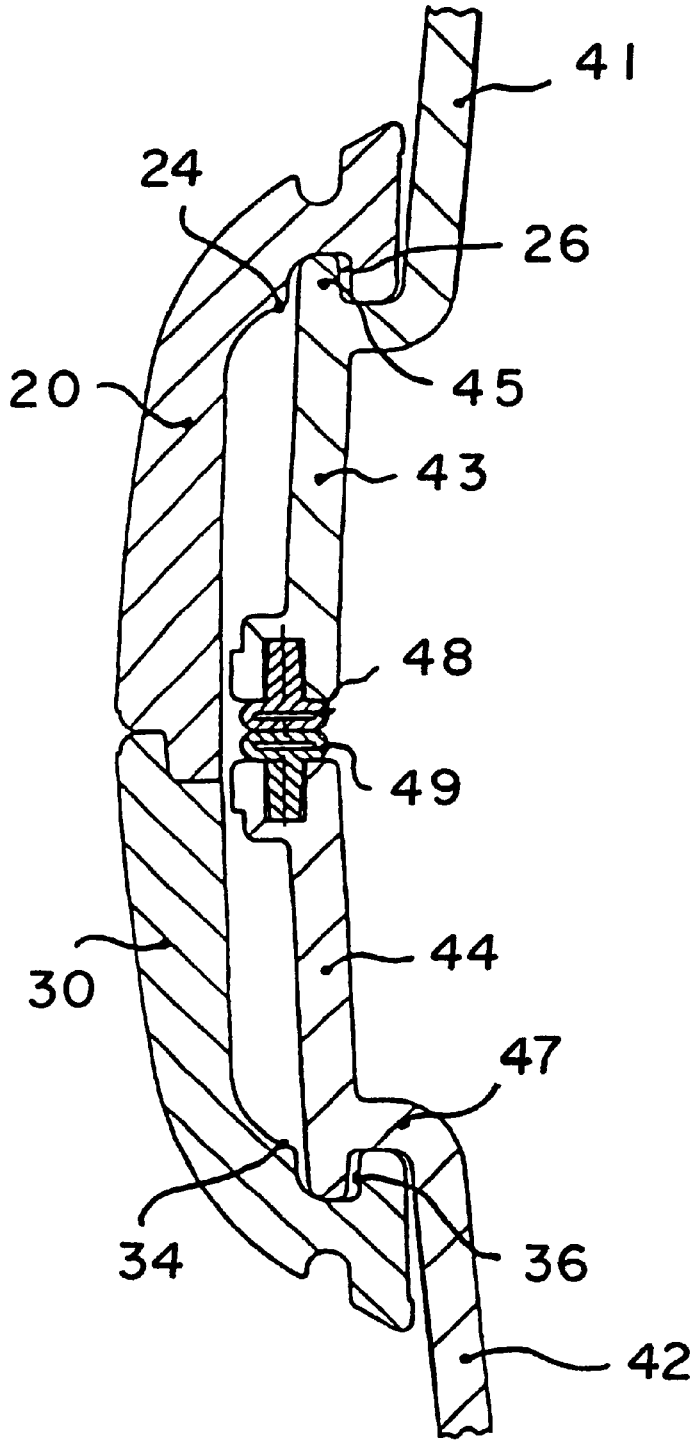
FIG. 3 shows essentially a section along line III—III of FIG. 2, although the frame halves, which were open in FIG. 2, are closed and the shells have been inserted.

A particularly advantageous configuration of the cross section of the frame halves 20, 30 with the shells 41, 42 inserted therein is illustrated in FIG. 3. It can be seen that the peripheral edge 24, 34, rather than just being designed as a stop, also has a channel 26, 36 in which a strip 45 of the peripheral bordering lip 47 of the shells 41, 42, said strip complementing the shape of the channel, can engage. This ensures that, when a heavy suitcase is lifted, the handle side 21, 31 does not move away from the top edge of the shells 41, 42, but rather the central part 10 and the shells 41, 42 are connected to one another in a dimensionally stable manner in the vertical direction. This illustration shows particularly clearly the extension of the shells 41, 42 by the surrounds 43, 44 beyond the bordering-lip region 47. In the closed state of the suitcase which is illustrated, the surrounds 43, 44 butt against one another at their borders. For a better sealing of the suitcase interior, in particular in order to prevent moisture from penetrating into the suitcase from the outside, elastic sealing strips 48, 49 are positioned in the borders of the surrounds 43, 44 and are pressed together upon closure of the suitcase.

Means 60, 70 for locking the shells 41, 42 in the associated frame half 20, 30 are arranged on the handle side 21, 31 of the frame halves 20, 30 (FIG. 1).

Figure 4:
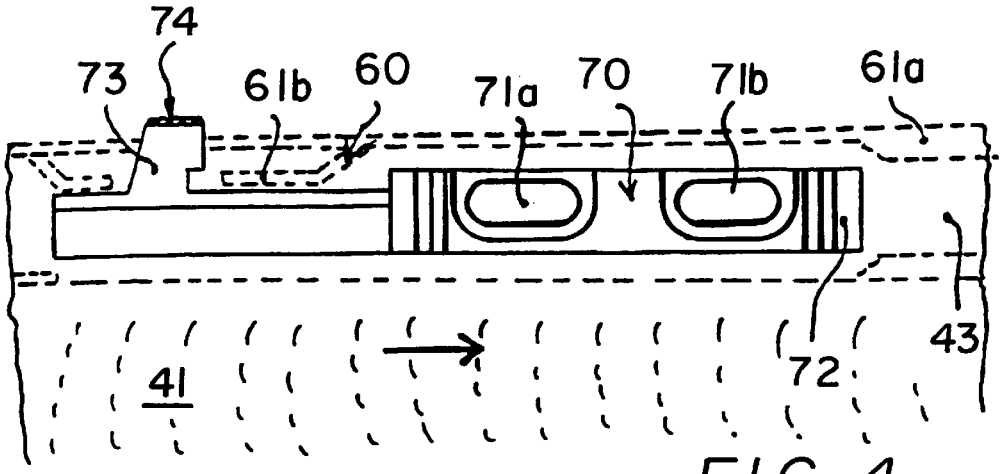
FIG. 4 shows a plan view of a slide as an exemplary embodiment of a shell-locking means.
Figure 5:
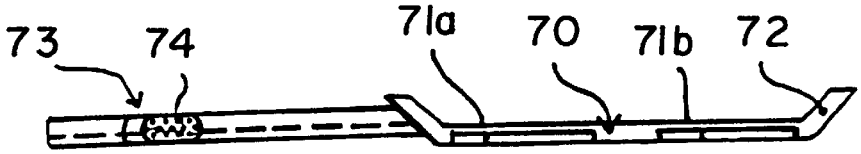
FIG. 5 shows a side view of the slide of FIG. 4.

As an example of such a locking means, FIGS. 4 and 5 illustrate a slide 70 in plan view and side view respectively. In the plan view of FIG. 4, moreover, dashed lines illustrate the corresponding spatial position of the engagement system 60, which is located on the surround 43 of the suitcase shell 41 and with which the slide 70 interacts.

The slide 70 has two slots 71*a*, 71*b* via which it can be fastened on the inside of the handle side 21 of the frame half 20 using screws or rivets (not illustrated). The slots 71*a*, 71*b* each have two slight convex portions which constitute a type of catch for the locked and unlocked positions. The slide 70 can be moved in the longitudinal direction in accordance with the dimensions predetermined by the slots 71*a*, 71*b*. For this purpose, it has an actuating web 73 which, to give a better grip, is provided with protuberances 74 on the top and can be moved, for example, by the user's thumbs. If the slide 70 is moved into its closed position (arrow direction in FIG. 4), a tongue 72 of the slide 70 engages in a rib channel

61*a* of the engagement system 60 and a cutout in the actuating web 73 comes into engagement with a fin 61*b* of the engagement system. The shell is then locked in position in the frame half.

The actuating web 73 of the mutually opposite slides project a short way beyond the closing edge 27, 37 (FIG. 2) of the frame halves 20, 30 and, in the locked state and when the suitcase is closed, thus secure one another against undesired unlocking.

For a suitcase with plastic shells, the engagement system and the shell may be formed together as a single unit.

Figure 6:
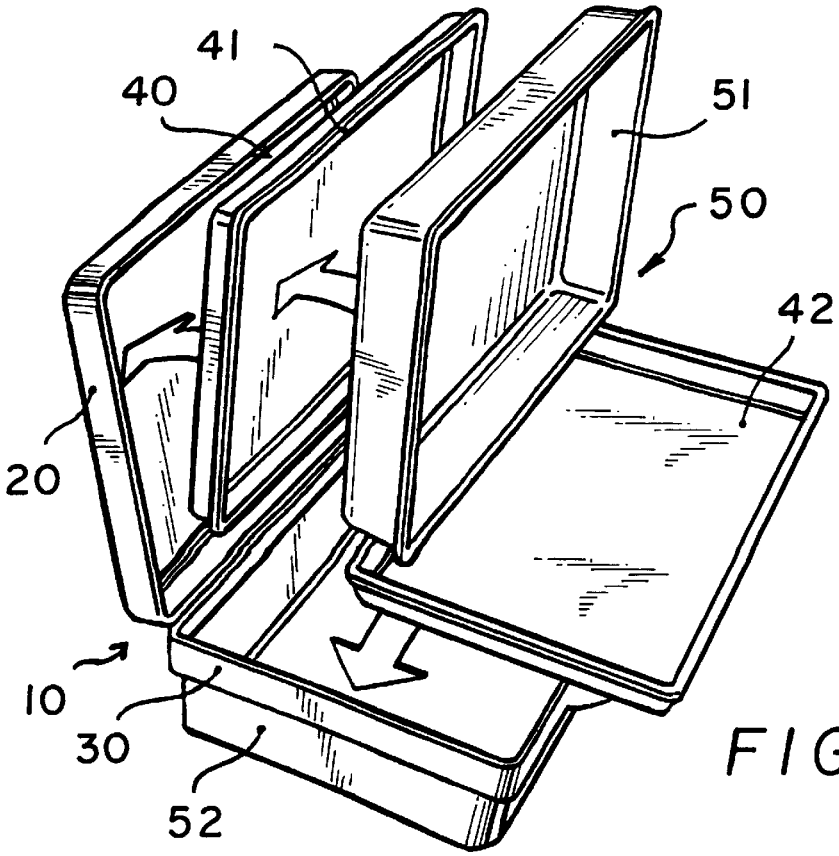
FIG. 6 shows a perspective view of a suitcase set according to the invention with shells of different volumes.

FIG. 6 shows a suitcase set which is formed by two frame halves 20, 30 and four shells 41, 42, 51, 52. The shells 41, 42 form a shallow shell set 40 and are of a smaller depth than the shells 51, 52, which form a deep shell set 50. For storage purposes, the shells 41, 42, 51, 52 may be positioned one inside the other, and thus require considerably less storage space than two complete suitcases.

In the region of the bottom corners, the suitcase shells 41, 42, 51, 52 preferably have feet, which each comprise a sphere located in a hemispherical socket integrally formed on the suitcase shells. The spheres preferably consist of hard rubber or plastic. They have the advantage over conventional suitcase feet that they do not cause scratching. Instead of the spheres, it is also possible to provide hemispherical or semicircular stands which consist, for example, of plastic and may have rubber inserts in the region of the standing surface.

The procedure for using the suitcase set according to the invention is as follows:

First of all, it is necessary to select the pair of shells which will best accommodate the volume of contents to be packed; the bordering lip 46 of the selected shell should then be made to engage behind the groove or the bead 25, 35; thereafter, the respective shell should be pressed into the associated frame half such that the peripheral bordering lip 47 rests on the peripheral edge 24, 34, and the strip 45 of the bordering lip 47 engages in the channel 26, 36 of the frame halves. Lastly, the two slides 70 in the associated frame half should be moved into their closed position, and the suitcase according to the invention is ready for use.

What is claimed is:

1. A suitcase having a central part (10) comprising two stable frame halves (20, 30) in communication with one another and supporting two shells (41, 42; 51, 52) that combine to form an interior to said suitcase, each of said frame halves (20, 30) includes a handle side (21, 31), a hinge side (22, 32) located opposite said handle side, and two mutually opposite side parts (23, 33), and each of said shells (41, 42; 51, 52) being releasably connected to the frame half (20, 30) assigned therewith, wherein a border belonging to each shell (41, 42; 51, 52) extends to form a surround (43, 44) dimensioned and configured so that when the suitcase is in a closed position, a surround (43) of the first shell (41; 51) having a first abutting edge and a surround (44) of the second shelf (42; 52) having a second abutting edge butt against one another and support one another, and said first and second abutting edges are provided with cooperating sealing elements each made of an elastic material such that in such closed position of said shells said seal elements cooperate to seal the interior of the suitcase.

2. The suitcase according to claim 1, wherein the sealing elements comprise sealing strips arranged at the abutting edges of the surrounds (43, 44).

3. The suitcase according to claim 1, wherein the surround (43, 44) extends on all sides except in the hinge region of the shell (41, 42; 51, 52).

4. The suitcase according to claim 1, wherein the surround (43, 44) connects to the shell (41, 42; 51, 52) via a peripheral bordering-lip region (47).

5. The suitcase according to claim 1, wherein each frame half (20, 30) has a peripheral edge located along the inside periphery, said peripheral edge having a channel (26) located in the region of the handle side (21, 31) and the side parts (23, 33) wherein a strip (45) of the surround (43, 44) of the shell (41, 42; 51, 52) engages with said channel (26).

6. The suitcase according to claim 1, wherein each frame half (20, 30) has a groove (25, 35) located on the inside of the hinge side (22, 32) in which a bordering lip (46) of the respective shell (41, 42; 51, 52) engages and at least one lock device located on the handle side locking on the respective shell (41, 42; 51, 52) in its frame half (20, 30).

7. The suitcase according to claim 6, wherein the lock device comprises a slide (70) which is fitted in a movable manner on the inside of the handle side (21, 31) of each frame half (20, 30) and interacts with an engagement system (60) provided on the handle side of the surround (43, 44) of the shell (41, 42; 51, 52).

8. The suitcase according to claim 7, wherein at least one slide (70) is arranged with the frame half (20) such that when the locking means is in a locked position, said at least one slide (70) of frame half (20) communicates with another slide arranged with the frame half (30) so as to prevent unlocking of said suitcase.

9. The suitcase according to claim 8, wherein each slide (70) has an actuating web (73) that projects in the direction of a closing edge (27) of the frame half (20) located along the periphery of the frame half (20) and mutually opposite another closing edge (37) of the frame half (30) when said suitcase is in a closed position, said actuating web (73) communicating with a mutually opposite actuating web so as to lock said suitcase.

10. The suitcase according to claim 1, wherein the suitcase shells (41, 42; 51, 52) are rigid or flexible shells.

11. A suitcase set comprising a suitcase according to claim 1 and a plurality of differently configured interchangeable shells.

12. The suitcase set according to claim 11, wherein at least two pairs of said interchangeable shells (41, 42; 51, 52) have different depths.

* * * * *